US005742965A

United States Patent [19]

Leask

[11] Patent Number: 5,742,965

[45] Date of Patent: Apr. 28, 1998

[54] GOLF CLUB HEAD CLEANER FOR WOODS AND IRONS

[76] Inventor: Ken J. Leask, 911 High Country Drive, High River, Canada, T1V 1E3

[21] Appl. No.: 717,154

[22] Filed: Sep. 20, 1996

[51] Int. Cl.[6] ..... A46B 13/02; A63B 57/00

[52] U.S. Cl. ..... 15/21.1; 15/88

[58] Field of Search ..... 15/21.1, 30, 34, 15/36, 88

[56] References Cited

U.S. PATENT DOCUMENTS

| | | | |
|---|---|---|---|
| 1,546,236 | 7/1925 | Haywwod | 15/34 |
| 3,332,099 | 7/1967 | Reiter | 15/21.1 |
| 3,439,370 | 4/1969 | McLaughlin | 15/21.1 |

*Primary Examiner*—Terrence Till
*Attorney, Agent, or Firm*—Dennis T. Griggs

[57] ABSTRACT

A coin-operated golf club cleaner cabinet is provided. Behind an access port in the front of the cabinet is mounted a structural housing comprising a rectangular box frame for supporting two pairs of cup-type brushes, positioned facing and in-line with a gap between them for receiving a golf club head. The first pair of brushes has aggressive bristles and forms a narrow gap between the facing brushes for cleaning irons, the second pair having softer bristles and a wider gap for cleaning woods. The housing has two small front curtained ports for permitting club access to the appropriate brush gap. Three in-line shafts provide two pairs of facing shaft ends upon which are mounted the two pairs of brushes. A line shaft and electric drive provide speed reduction to the three in-line shafts. For convenient access of the brushes for adjustment and maintenance purposes, the housing can be pivoted within the cabinet to present its substantially open base to the cabinet's access port. Cleaning fluids are circulated from a tank located beneath the housing and up to the brushes. The tank is mounted on rails for ready access and removal outside the side of the cabinet. A coin-operated duration time provides convenient actuation of the brush drive motor and pump.

4 Claims, 5 Drawing Sheets

GOLF CLUB HEAD CLEANER FOR WOODS AND IRONS

FIELD OF THE INVENTION

The invention relates to opposing, brush type apparatus for cleaning the heads of golf clubs. More particularly, the apparatus is automatically coin-actuated and readily maintained.

BACKGROUND OF THE INVENTION

The heads of golf clubs are available in basically two forms; "woods" and "irons." These two types of clubs require different cleaning treatments; woods generally being larger and having a more specialized finish which is more easily damaged than is the iron variety. Typically, woods are constructed of wood, metals like titanium, and graphite composites.

Prior art cleaners involved either opposing and fixed brushes or motorized cylindrical brushes mounted on parallel and spaced apart rotating shafts.

One such apparatus is disclosed in U.S. Pat. No. 4,541,138 to Varrial which provides two pairs of cylindrical brushes; one pair having stiff, more aggressive bristles for cleaning irons, and one pair having softer bristles for cleaning woods. Each brush of a brush-pair are parallel and spaced so that the periphery of their radially extending bristles are in close proximity, forming a nip. A club is inserted into the nip for cleaning. Varrial reduces structural loads imposed on the club heads by co-rotating the brushes so that the bristles in the nip move in opposite directions.

Limitations of the Prior Art club-cleaning machine include:

- inability to adapt to the larger heads of contemporary clubs;
- the alignment, of both the club and the axes of the brushes in each pair, is critical to achieving proper cleaning. More specifically, for cleaning irons, the Prior Art's design requires
  - positioning the upper shaft of the two parallel brushes slightly rearward than the lower brush's shaft for better contacting of the head, and
  - a "V"-shaped guide behind the brushes for guiding the club's head and a narrow opening through which the golf club shaft extends for constraining the club's orientation closely;
  - for cleaning woods, the upper brush is soft and the lower brush is stiff, accepting only one alignment for insertion of the club; and
- access and maintenance of the mechanical componentry of the machine is awkward and time consuming.

Thus, there is a skill threshold required for achieving satisfactory cleaning results, not necessarily achievable by the average golf enthusiast. Further, while the Prior Art acknowledges the importance of maintenance issues, they have not been successfully or conveniently addressed.

SUMMARY OF THE INVENTION

The present invention provides a gold club head cleaning machine which substantially eliminates head alignment requirements and is simple to maintain.

The apparatus comprises a cabinet having an access port through which a golf club head is inserted for cleaning. The head passes through small, curtained ports in a cleaning assembly to engage either a cleaning section for woods or one for irons. Each section houses a pair of cup-type and facing brushes which are mounted to the facing ends of parallel and in-line rotating shafts. The club's head is inserted into a gap formed between the brushes which is slightly smaller that the head. The gap is adjustable for accepting a nominal size of club head expected. The bristles are less aggressive (softer) and the gap is wider for the brushes in the wood-cleaning section than they are in the iron-cleaning section. Water is circulated, in a closed loop, to the brush's bristles, and is collected in a tank for recirculation with a pump.

Preferably, the two sections are arranged side-by-side and have substantially open bases, providing easy access for maintenance of the brushes. Further, the cleaning assembly is pivotally mounted within the cabinet for presenting the open bases to the cabinet access port, enabling ready maintenance therethrough without removal of the assembly from the cabinet.

DETAILED DESCRIPTION OF THE PREFERRED EMBODIMENT

Figure 1:
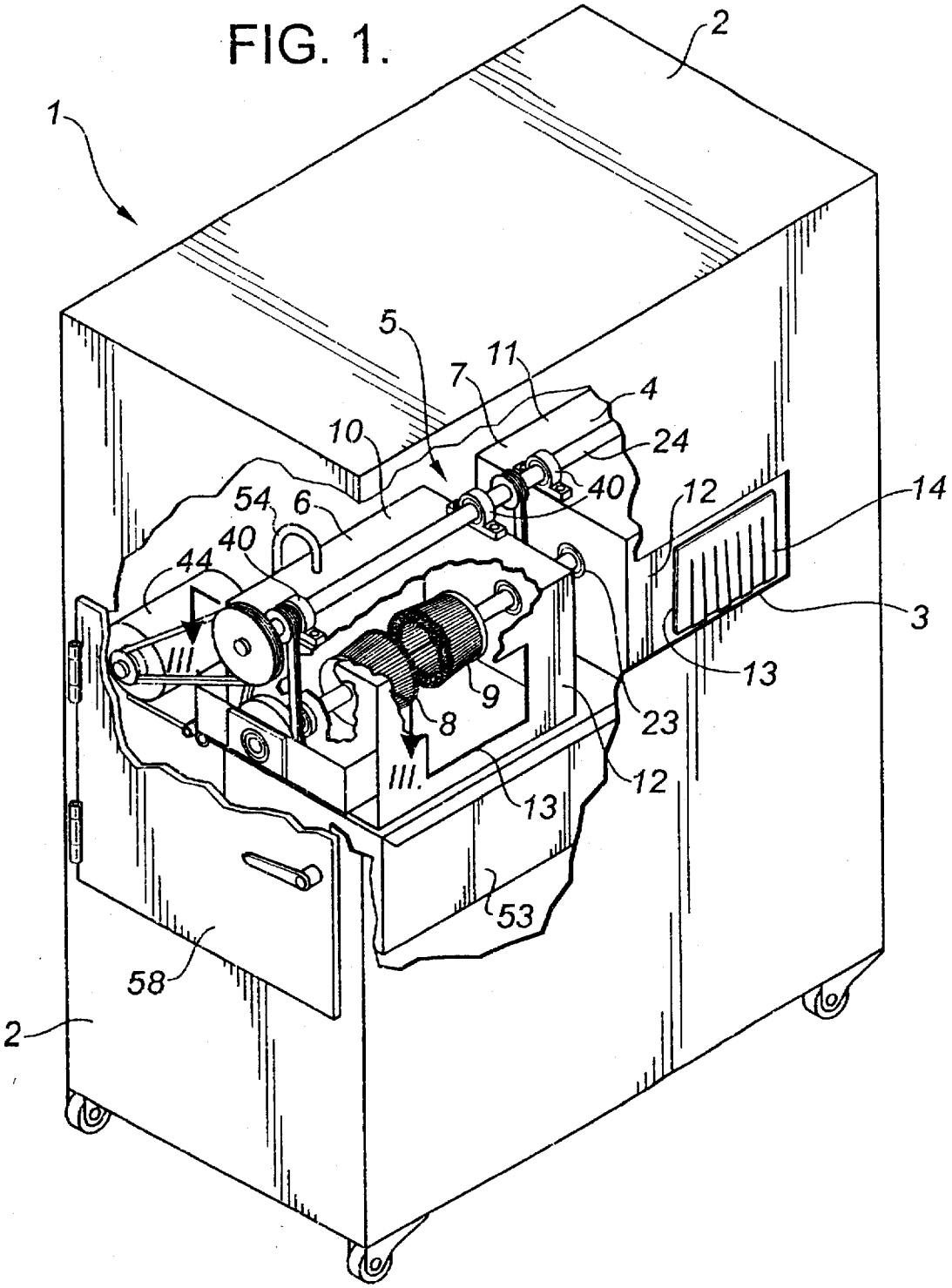
FIG. 1 is a perspective view of the preferred embodiment of the present invention, having the enclosed cleaning assembly exposed with a cutaway view through the cabinet.
Figure 2:
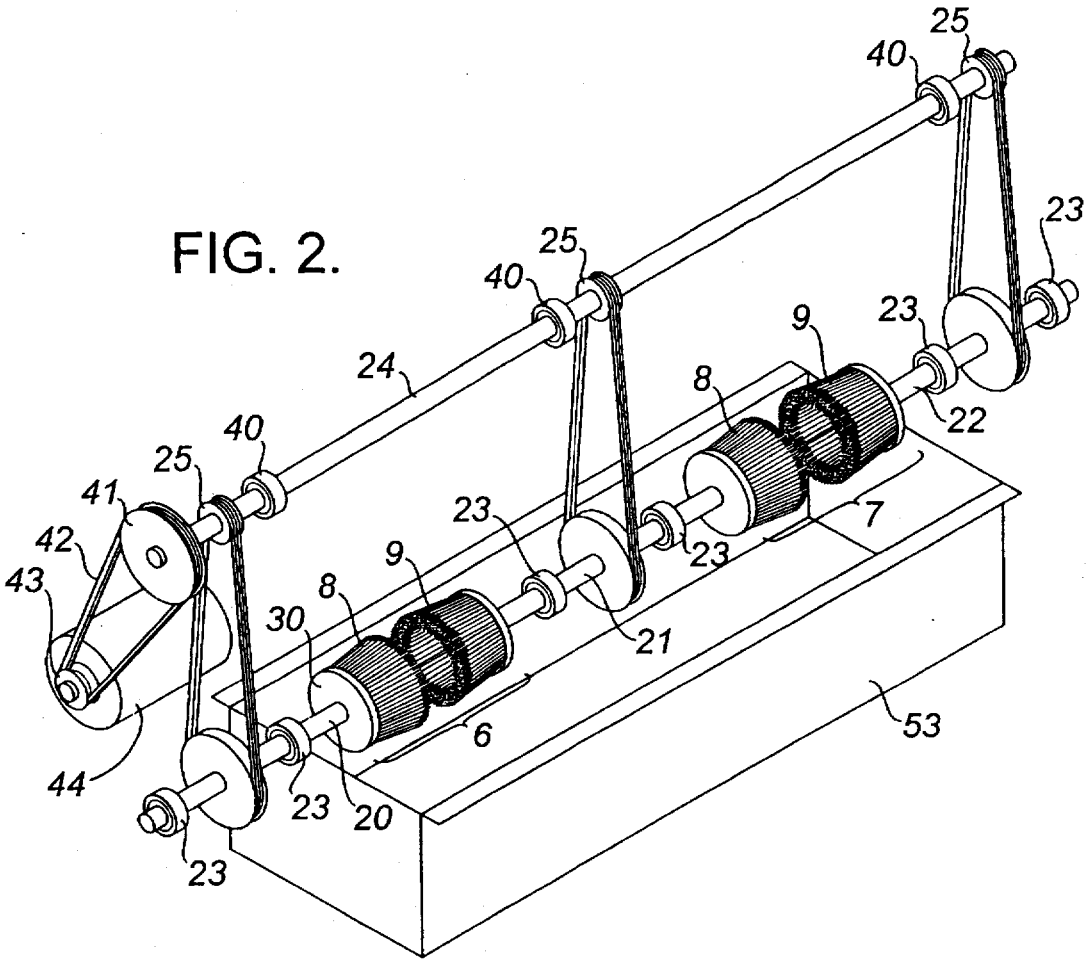
FIG. 2 is partial perspective view of the two, iron and wood cleaning section brushes, and the cleaning fluid tank.

Having reference to FIGS. 1 and 2, a golf club cleaning machine 1 comprises a freestanding cabinet 2 having a golf club head cleaning access port 3. Within the cabinet 2, behind the access port 3, is a cleaning assembly 4.

The cleaning assembly 4 comprises a structural housing 5 supporting a pair of cleaning sections, a first section 6 for cleaning iron-type golf clubs ("irons"), and a second section 7 for cleaning wood-type golf clubs ("woods"). Each cleaning section 6,7 comprises a pair of opposing and rotating first and second brushes 8,9.

The two sections 6, 7 are 8" high×8" deep by 12" wide rectangular boxes 10, 11 respectively which are positioned side-by-side, spaced apart about 3". The front wall 12 of the boxes 10,11 reside just within the cleaning access port 3 in the cabinet 2. Small 5"×5" club-access ports 13 are formed in the front wall 12 of each box 10,11. The ports are fitted with splash flaps or curtains 14 having vertical splits extending upwards from their lower edge.

Referring now to FIG. 2, the two opposing brushes 8,9 from the first section 6 are mounted to the facing ends of a first shaft 20 and a second shaft 21. The two opposing brushes 8,9 from the second section 7 are mounted to the facing ends of the second shaft 21 and a third shaft 22. The axes of the shafts 20, 21, 22 are parallel and in-line and extend through the rectangular box housing 5.

The horizontal brush shafts 20, 21, 22 are ⅝" diameter shafts supported by bearings 35 mounted to the sides of the housing 5 and are driven from a parallel line shaft 24.

The first shaft 20 is supported from bearings 23 at its first end and inboard from the brush 8 at its second end. The second shaft 21 is supported by bearings 23 inboard of the brushes 8,9 at both its first and second ends. The third shaft 22 is supported from bearings 23 at it second end and inboard from the brush 9 at its first end. The bearings are mounted outside the walls of the boxes 10,11 for isolation from cleaning fluids.

Figure 4:
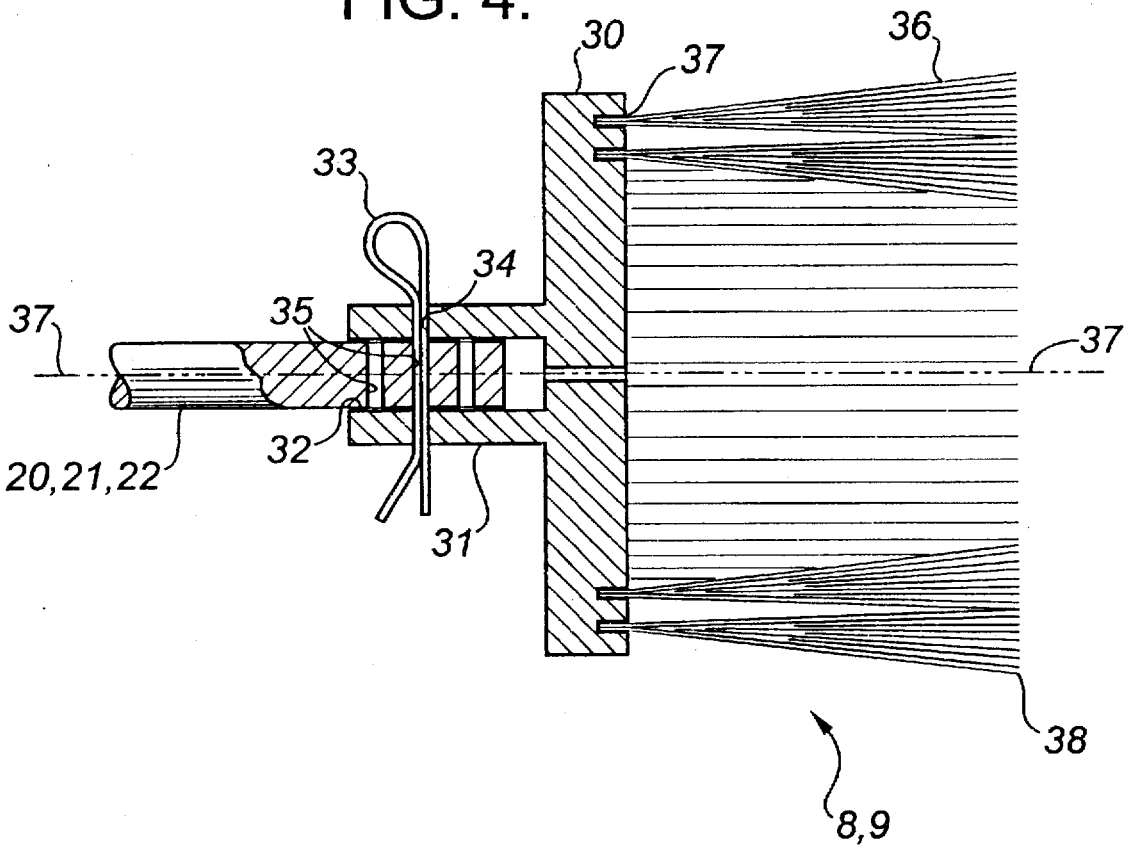
FIG. 4 is a cross-sectional view of one of the brushes and the cotter pin adjusting means.

Having reference to FIG. 4, each brush 8 or 9 is cup-shaped, comprising a circular backing disk 30 which has a shank 31 having a bore 32 through its center for mounting to the end of the shafts 20, 21, 22. Means, such as a cotter pin 33 and a plurality of corresponding holes 34, 35 in the shank 31 and the shaft 20 are provided to permit positioning of the disk 30 to a plurality of axial positions. A plurality of bristles 36 are arranged circumferentially about the periphery 37 of each disk 30. The bristles 36 are mounted at their base to the disc 30 and extend outwardly substantially perpendicularly from the plane of the disc. Thus, the axis 37 of a shaft 20 and the bristles 36 are substantially parallel to form a cup-type of brush.

Figure 3:
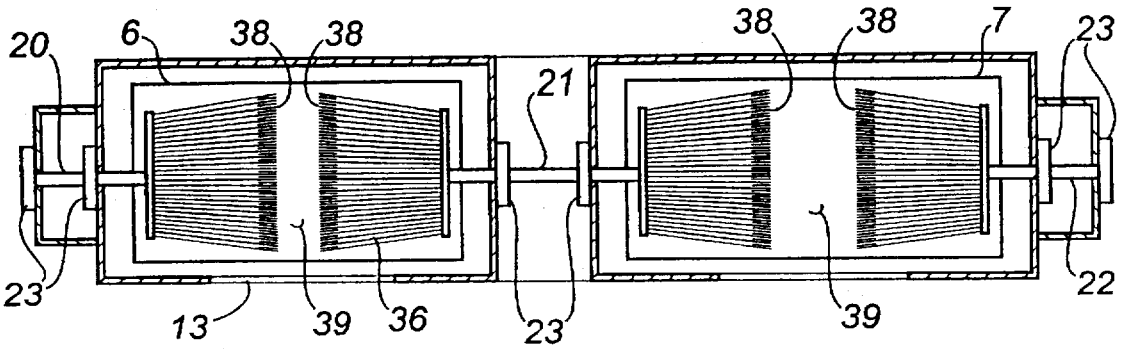
FIG. 3 is a partial top cross-sectional view of the cleaning assembly showing the facing brushes of the iron and wood cleaning sections.

Turning to FIG. 3, the ends 38 of the bristles 36 from the brush 8 are spaced axially from the ends 38 of the bristles of brush 9, thus forming a gap 39 therebetween. The size of the gap 39 is adjustable by re-positioning the discs 30 on the facing shafts 20, 21 or 21, 22.

The iron and wood sections 6,7 are identical except for the materials of construction of the bristles 36 and the size of the gap 39 between the brush pairs 8,9. The bristles for cleaning woods are soft to avoid damage to the wood portion of the head, and the gap is set nominally at about 1¼ inches. The bristles for cleaning irons are stiffer, or more aggressive and the gap is narrower at a nominal ¾ inches.

More particularly, applicant has successfully employed 5" diameter plastic brush disks, having bristles staple-set into drilled holes around the disk's periphery. A ⅝" drilled shank is provided for mounting to ⅝" shafting. For the wood-cleaning brushes, 2" long, mixture of 0.010, 0.014, and 0.017" polypropylene crimped bristles are used. For cleaning irons, 2" long, 0.022" crimped NYLON* bristles are used. The brushes are adapted from upholstery cleaning brushes and are available as Model 5000 from Fiberbuilt Manufacturing Inc., Calgary, AB.

Turning to the means for driving the brushes, the line shaft 24 extends the length of the first through third shafts 20, 21, 22 and is parallel to them.

Three chain speed-reduction drives 25 (about 2.2:1) extend from the line shaft 24 for transmitting power and rotating the three brush shafts. The line shaft 24 is supported from pillow-block bearings 40 mounted atop the housing 5. A line shaft pulley 41 is mounted on one end of the line shaft 24. A belt 42 extends between a drive pulley 43 on a ¼ hp electric motor 44 and the line shaft pulley 41 for rotation of the line shaft 24 and speed-reduction (about 3.6:1). Thus, using a 1725 rpm motor, the brushes 8,9 rotate at about 220 rpm.

Figure 5:
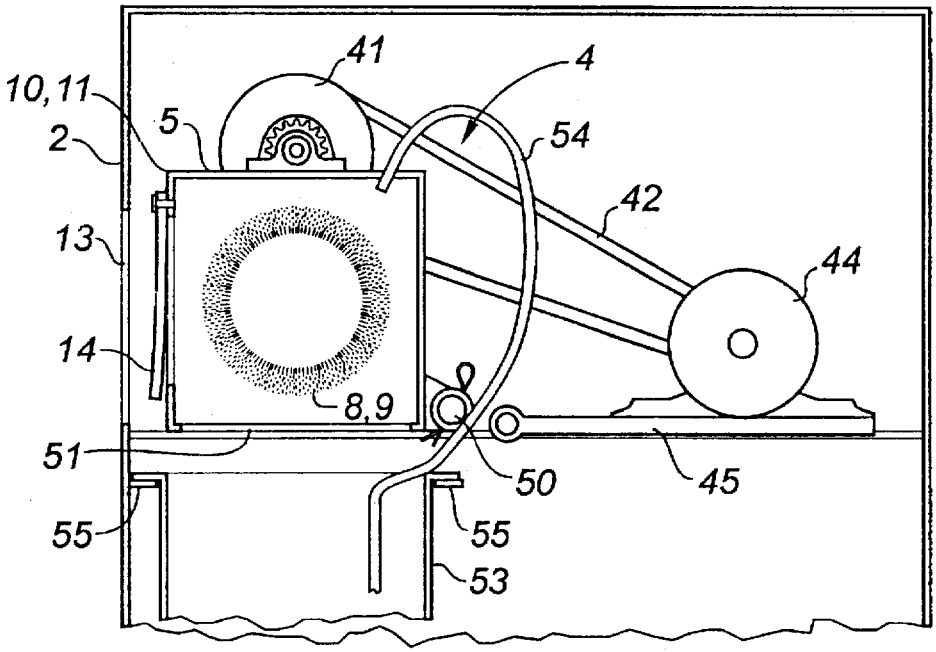
FIG. 5 is a partial cross-sectional view of the cabinet and cleaning assembly, taken along line V—V of FIG. 3, showing the pivoting housing and motor drive as it would be arranged for operation.
Figure 6:
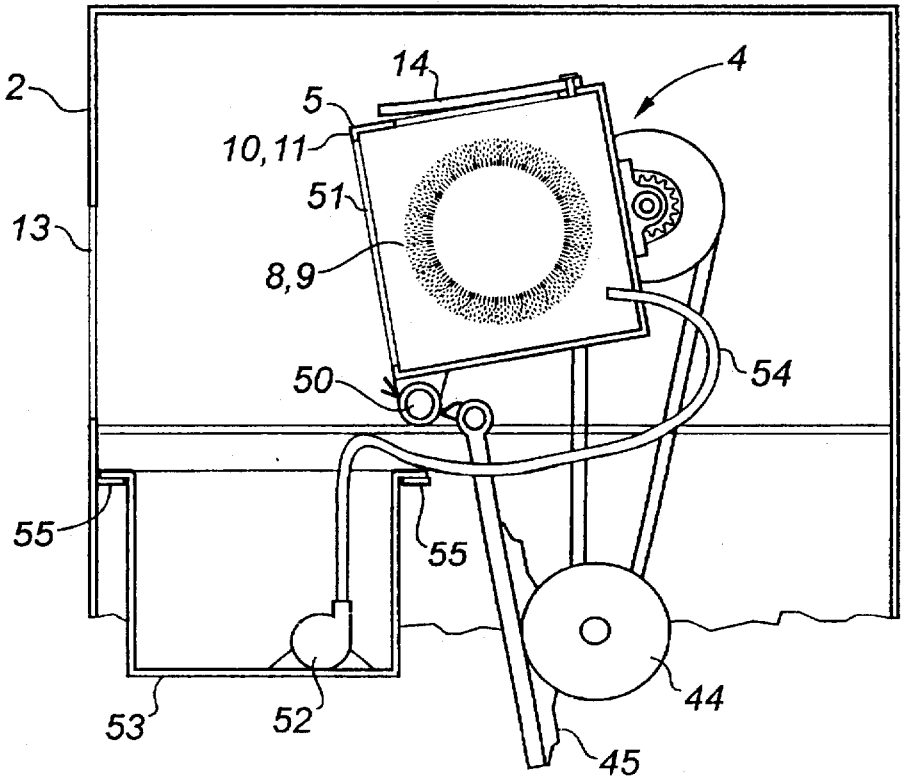
FIG. 6 is a partial cross-sectional view of the cabinet and cleaning assembly, taken along line V—V of FIG. 3, showing the pivoting housing and motor drive as it would be arranged for maintenance access to the brushes.

As shown in FIGS. 5, 6, the motor 44 is supported on a pivoting base 45 for utilizing the motor weight to maintain belt tension in operation.

The assembly 4 is rotatable from a pivot 50 at the lower rear corners of the boxes 10, 11. Thus, the base 51 of the assembly 4 can be rotated upwards and rearwards to permit access through the cabinet access port 3. The base 51 of each section 6,7 is substantially open about 6"×10" for permitting relatively unrestricted maintenance access to the brushes 8,9. The open base permits access to the brushes to enable ready inspection, replacement or adjustment of the gap 39 between brushes 8,9 by shifting the cotter pins 33.

Water circulation is provided to enable improved cleaning of the clubs. Pump 52 draws water from a tank 53, positioned beneath the assembly 4, and circulates a closed loop of water through a ¼" line 54 to discharge onto the brushes 8,9 during operation. A suitable pump is available as a submersible "LITTLE GIANT" model 500286 pump distributed by Western Pump, Calgary, AB.

Waste water from the brushes 8,9 drain through the box's open base 51 and into the tank 53. The tank 53 is slidably mounted on horizontal rails 54 for ease of access and servicing through a side door (not shown) in the cabinet.

Figure 7:
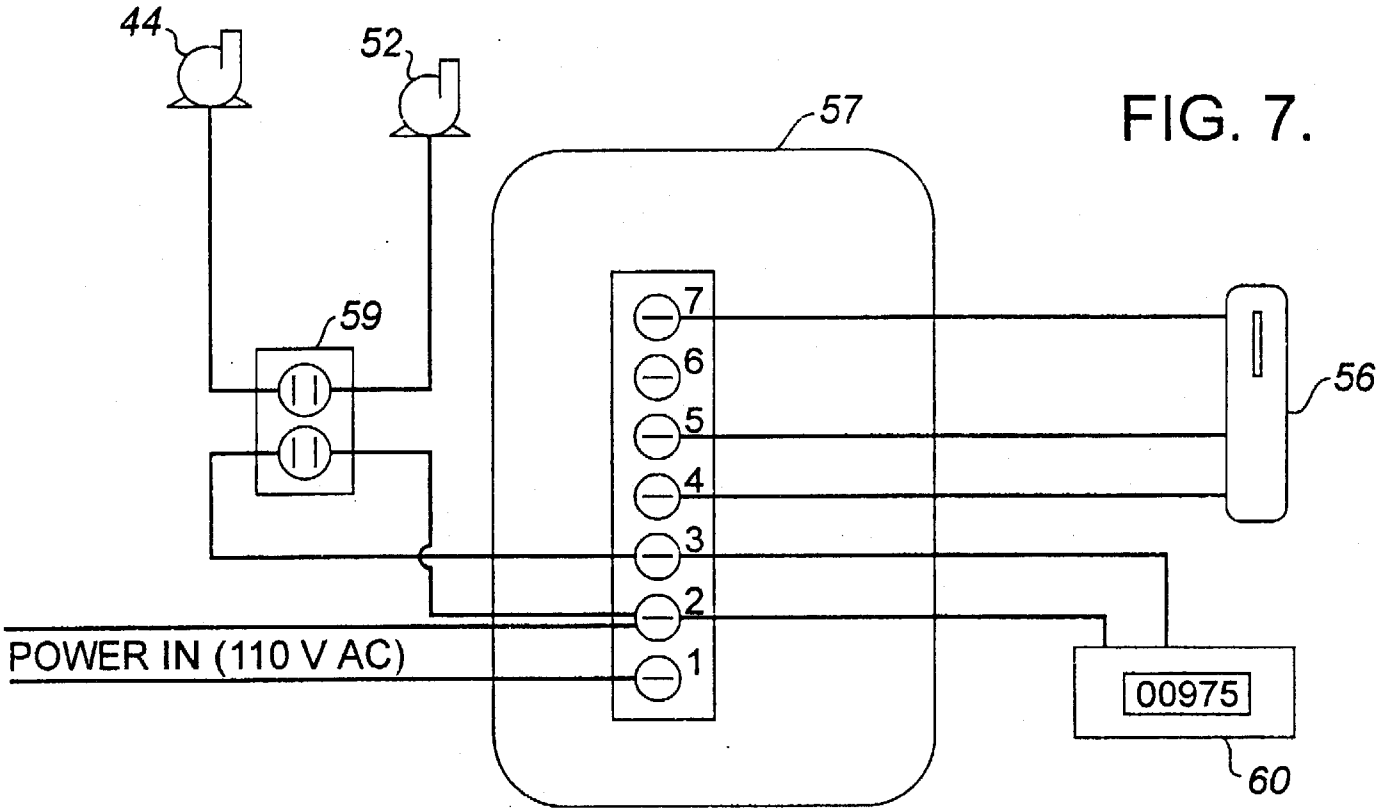
FIG. 7 is a simplified schematic of the coin-operated timer system.

Having reference to FIG. 7, the motor 44 and pump 52 are actuated with a coin-operated switch 56 and timer 57 located behind an access door 58 (FIG. 1). The coin-actuated switch (model HP010355-100 "SLUGBUSTER" from Lynco Products Inc., Calgary AB), signals the conventional timer 57 which provides a set duration (say about 3 minutes) of electrical power to a plurality of electrical output ports 59. The timer 57 is supplied with 110 VAC line source power. A counter 60 conveniently indicates the number of coin-operated uses.

In operation, a golfer inserts the required denomination of coins to activate the cleaner. The timer 57 powers the motor 44, which rotates the brushes, and the pump 52, which circulates cleaning fluid to the bristles 36. The golfer inserts the golf club through the appropriate access port 13 for either iron or wood heads. The facing brushes 8,9 capture the club's head and the bristles 36 clean the club's surfaces.

The orientation of the club's head is not critical and the cleaning action can be intuitively manipulated by the golfer by rotating the club's head about its handle, up to ½ turn in either direction. The head can be withdrawn, inspected and reinserted as required.

Accordingly, the invention is characterized by the following advantages:

- the apparatus is simple to use and substantially insensitive to club orientation;
- the bristle gap can be readily adjusted to handle the more contemporary larger headed club heads;
- little force is needed to provide effective cleaning;
- inspection, adjustment and maintenance are easily performed by merely rotating the assembly 90 degrees; and
- the entire brush assembly can be removed in less than one minute.

The embodiments of the invention in which an exclusive property or privilege is claimed are defined as follows:

1. A golf club head cleaning apparatus comprising:

a structural housing forming first and second head-cleaning sections wherein each section has a pair of facing brushes, a pair of rotating shafts having ends facing and spaced from each other, said brushes being cantilevered from the facing and spaced ends of said rotary shafts, said rotary shafts having axes are in-line, said brushes each having a backing disc, each backing disc having bristles which are mounted thereon which in a circular pattern along a periphery of the backing disc, the backing disc being centrally mounted on the shaft end, the bristles extending substantially axially outwards to a distal end defining a cup-shape, so that the facing brush's respective bristles extend toward each other, the distal ends of bristles of facing brushes being adjacent and spaced so as to form a gap between them, and the first section having aggressive bristles and said facing brushes forming a narrow gap suitable for cleaning irons, the second section having less aggressive bristles and said brushes forming a wider gap suitable for cleaning woods;

ports formed in the housing for permitting access and insertion of a wood or iron club head into the appropriate gap formed between brushes, the club being inserted substantially perpendicularly to the rotational axis of the brushes;

means for rotating the shafts;

means for circulating cleaning fluids to the brushes and collecting waste fluids; and a cabinet having walls to completely enclose the housing and fluid circulation means, and having a port formed in one of the walls which aligns with the housing's access ports for permitting passage of the club head through to the cleaning sections.

2. The cleaning apparatus as recited in claim 1 wherein the two cleaning sections are arranged side-by-side.

3. The cleaning apparatus as recited in claim 2 wherein the rotary shafts comprise three in-line shafts, each shaft having first and second ends, the first shaft having one of a first pair of said facing brushes cantilevered from said second end, and the other brush of the first pair of said facing brushes cantilevered from the first end of the second shaft so that the two brushes are facing each other with a gap formed therebetween, and the second shaft having one of the second pair of facing brushes cantilevered from said second end and the other brush of the second pair of facing brushes cantilevered from the first end of the third shaft so that the two brushes are facing each other with a gap formed therebetween.

4. The cleaning apparatus as recited in claim 3 wherein the structural housing further comprises:

a rectangular box frame having a vertical front, top, two sides and a bottom wall, club access ports being formed in the front vertical wall, a large maintenance access port being formed in the bottom wall; and pivots extending from the side walls for rotationally mounting the housing within the cabinet so that the housing can be rotated to present the bottom maintenance access port towards the cabinet port for ease of inspection and maintenance therethrough.

* * * * *

UNITED STATES PATENT AND TRADEMARK OFFICE

CERTIFICATE OF CORRECTION

PATENT NO. : 5,742,965
DATED : Apr. 28, 1998
INVENTOR(S) : Ken J. Leask

It is certified that error appears in the above-indentified patent and that said Letters Patent is hereby corrected as shown below:

Col. 1, line 33, "Prior Art" should be -- prior art --.

Col. 1, line 39, "Prior Art's" should be -- prior art's --.

Col. 1, line 55, "Prior Art" should be -- prior art --.

Col. 3, line 25, "disc" should be -disk --.

Col. 3, line 48, "NYLON$^{X}$" should be -- NYLON --.

Claim 1, Col. 4, line 65, after "axes" insert -- which --.

Claim 1, Col. 5, line 1, delete "which".

Claim 1, Col. 5, line 13, before "brushes" insert -- facing --.

UNITED STATES PATENT AND TRADEMARK OFFICE

CERTIFICATE OF CORRECTION

PATENT NO. : 5,742,965

DATED : April 28, 1998

INVENTOR(S) : Ken J. Leask

It is certified that error appears in the above-indentified patent and that said Letters Patent is hereby corrected as shown below:

Claim 1, col. 5, line 13, before "brushes" insert -- facing--.

Signed and Sealed this

Twenty-fifth Day of August, 1998

Bruce Lehman

*Attest:*

BRUCE LEHMAN

*Attesting Officer*

*Commissioner of Patents and Trademarks*